US005154524A

United States Patent [19]

Anderson

[11] Patent Number: 5,154,524

[45] Date of Patent: Oct. 13, 1992

[54] ONE GALLON CAR WASHING DEVICE

[76] Inventor: Ronald H. Anderson, 261 Gundry Dr., Falls Church, Va. 22046

[21] Appl. No.: 785,423

[22] Filed: Oct. 28, 1991

[51] Int. Cl.[5] ..... A47L 13/17

[52] U.S. Cl. ..... 401/203; 401/186; 401/188 R; 401/204; 401/289

[58] Field of Search ..... 401/289, 203, 204, 201, 401/188 R, 186

[56] References Cited

U.S. PATENT DOCUMENTS

| | | | |
|---|---|---|---|
| 800,254 | 9/1905 | Willis | 401/204 |
| 1,359,985 | 11/1920 | Gromer | 401/204 X |
| 1,394,282 | 10/1921 | Crosby | 401/204 |
| 1,426,606 | 8/1922 | Sandholm | 401/204 X |
| 2,526,119 | 10/1950 | Cravis | 401/204 |
| 2,779,962 | 2/1957 | Cooper | 401/203 X |
| 2,919,455 | 1/1960 | Turner | 401/9 |
| 3,063,084 | 11/1962 | Marinus | 401/203 |
| 3,713,744 | 1/1973 | Sims | 401/9 |
| 4,134,697 | 1/1979 | Sparr, Sr. | 401/289 X |
| 4,789,262 | 12/1988 | Sanchez | 401/201 |
| 4,886,388 | 12/1989 | Gulker et al. | 401/148 |

FOREIGN PATENT DOCUMENTS

| | | | |
|---|---|---|---|
| 1298888 | 7/1969 | Fed. Rep. of Germany | 401/203 |
| 1052041 | 1/1954 | France | 401/188 |
| 878521 | 10/1961 | United Kingdom | 401/203 |

*Primary Examiner*—Steven A. Bratlie
*Attorney, Agent, or Firm*—David A. Testardi

[57] ABSTRACT

A car-washing device includes a one-gallon reservoir and flexible tubing leading from the reservoir to a sponge. The sponge has a central passage formed therein to securely receive a portion of the tubing that has been provided with a plurality of small openings. A detergent formula thus flows in the tubing from the reservoir and through the small openings into the sponge. A removable and replaceable protective jacket, in the form of a nylon sleeve, protects the sponge. A valve member is provided between the reservoir and the sponge to selectively cut off the flow of detergent to the sponge. In use, the reservoir may be placed on top of a car and the sponge may be manipulated to clean the outer surfaces of the car. Because the detergent flows from a passage in the center of the sponge, the sponge is, for the most part, self-cleaning.

20 Claims, 3 Drawing Sheets

ONE GALLON CAR WASHING DEVICE

BACKGROUND OF THE INVENTION

1. Field of the Invention

This invention pertains to the field of portable washing implements. More particularly, this invention pertains to the field of portable, car washing implements which conserve water and which are reusable and self-cleaning.

2. Description of the Related Art

Various portable washing implements have been proposed in the prior art. Examples of these implements are shown, for example, in U.S. Pat. Nos. 2,919,455, 3,713,744, and 4,886,388. These prior art implements generally comprise a cleaning element (e.g. in the form of a sponge), a handle element supporting the cleaning element, and a reservoir secured e.g. to or within the handle element for holding detergent. However, while these implements perform adequately as general household cleaning devices, they are not particularly suited for cleaning large, dirty surfaces such as the outer body panels of an automobile. Specifically, owing to their relatively small detergent reservoirs (which are generally intended to hold concentrated detergent) and also to the configuration and properties of the sponge material, these implements are not particularly adapted to shed the large amounts of dirt and debris which are encountered during automobile cleaning.

SUMMARY OF THE INVENTION

It is an object of the present invention to provide a portable car-washing implement which simultaneously facilitates car-washing and conserves water.

It is another object of the invention to provide a portable car-washing implement which is relatively simple in structure and, therefore, readily manufactured.

Specifically, the present invention comprises a device for washing automobiles which includes: a container cap; a first length of tubing extending from one side of the container cap; a second length of tubing extending from a second side of the container cap; passage means extending through the container cap for connecting an internal passage of the first length of tubing with an internal passage of the second length of tubing; means for at least substantially closing an end of the second length of tubing remote from the container cap; a plurality of small openings formed in a portion of the second length of tubing in a vicinity near the end of the second length of tubing; an element of porous, absorbent material secured to the second length of tubing and covering the plurality of small openings; and a protective jacket disposed around and substantially covering the element of porous, absorbent material; wherein the container cap is adapted to be secured to an opening of a detergent-holding container after the first length of tubing has been inserted into the detergent-holding container, wherein the internal passage of the second length of tubing is adapted to carry a flow of detergent from the detergent-holding container to the small openings, and wherein the small openings are adapted to carry the detergent to the element of porous, absorbent material; and wherein the device further comprises: valve means, disposed at a position on the second length of tubing between the container cap and the element of porous, absorbent material, for selectively closing the internal passage, the valve means being adapted to selectively prevent the flow of detergent in the internal passage.

The invention will, however, be best understood by a review of the following specification in conjunction with the accompanying drawings, in which:

DETAILED DESCRIPTION OF THE PREFERRED EMBODIMENT

Figure 1:
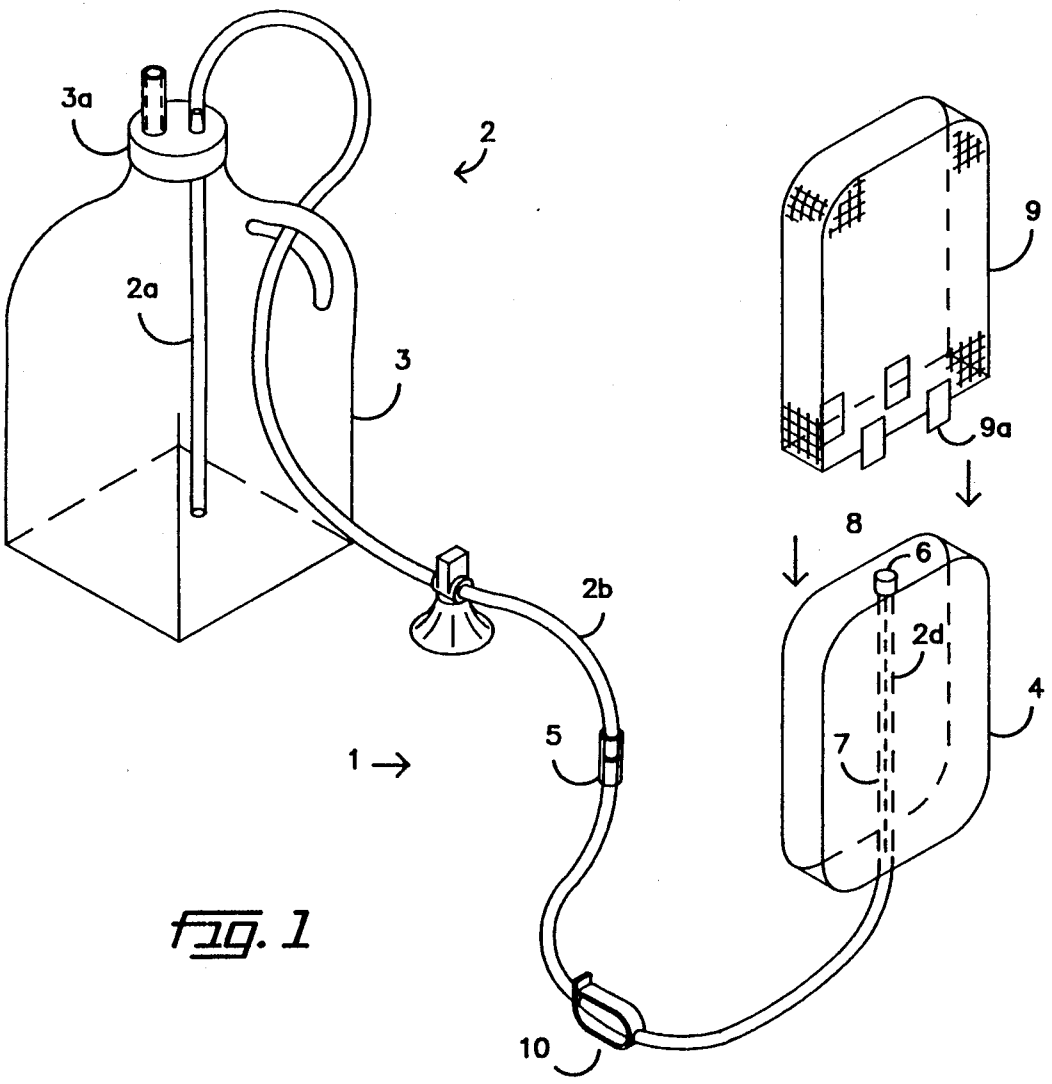
FIG. 1 is a perspective view of the device for washing automobiles according to the invention with the protective jacket removed from the sponge.

Referring first to FIG. 1, there is shown generally at 1 the car-washing device according to the present invention. The device 1 includes flexible tubing 2 through which a detergent or other cleaning fluid is adapted to be fed from a reservoir 3 (which may, according to the present invention, comprise a one-gallon container) to a sponge 4. According to the presently preferred embodiment, the tubing comprises a first length of tubing 2*a* extending downwardly from a cap 3*a* of the reservoir 3 and a second length of tubing (comprising tube segments 2*b*, 2*c*) extending from the cap 3*a* of the reservoir 3 to the sponge 4. (It is noted that the term "cap" as used herein denotes any element which is disposed in, on, or around an opening of the reservoir 3 for the purpose of at least partially restricting, controlling, or capping a flow of fluid from the reservoir; as such, a rubber stop or cork would constitute a cap in this context.) Each of the tube segments 2*a*, 2*b*, 2*c* are made from e.g. ¼ inch O.D. synthetic siphon tubing and are joined together in a fluid tight manner by fluid tight connecting means. The fluid tight connecting means which join together the tube segments 2*a*, 2*b* are provided on the container cap 3*a* and will be more particularly described with reference to FIG. 2. The fluid tight connecting means which joins together the tube segments 2*b*, 2*c* is shown at 5 in FIG. 1 and comprises a short segment of ⅜ inch O.D. vinyl tubing within which opposing ends of the tube segments 2*b*, 2*c* are received in abutting relationship. In the preferred embodiment, the second length of tubing (comprising the tube segments 2*b*, 2*c*) is at least 4 feet long. Of course, the flexible tubing 2 could be manufactured as a single tube segment without departing from the essence of the invention.

At the free end 2*d* of the second length of tubing, a small cap 6 is secured to the tubing so as to at least substantially close the free end 2*d*, thereby preventing (or at least inhibiting) a free flow of detergent out of the free end 2*d* of the tubing. Moreover, a plurality of small openings 7 are provided at a portion of the second length of tubing near to the free end 2*d*. These openings 7 may, for example, be in the form of holes drilled into the tubing.

According to the invention, the sponge 4 is provided with a central passage 8 into which the portion of the second length of tubing having the small openings 7 is inserted. In order to secure the sponge 4 to the second length of tubing, a gluing agent or other chemical bonding agent may be applied to the tube segment 2*c* and/or the sponge 4. A protective jacket 9 is configured so as to be secured around and cover the sponge 4. Preferably, the protective jacket 9 is made in the form of a nylon sleeve and comprises separable hook and loop type fasteners 9*a* at an open end thereof. These fasteners 9*a* (which may comprise VELCRO brand fasteners) are adapted to be closed once the sleeve 9 has been slipped over the sponge 4 in order to retain the sleeve 9 in position.

Carried by the second length of tubing (e.g. on the tube segment 2*c*), there is provided a valve means 10. This valve means 10 (which will be described in more detail with reference to FIG. 3) may comprise a valve in the form of a pinch clamp. The valve means 10 is adapted to selectively cut-off fluid flow inside the second length of tubing.

Figure 2:
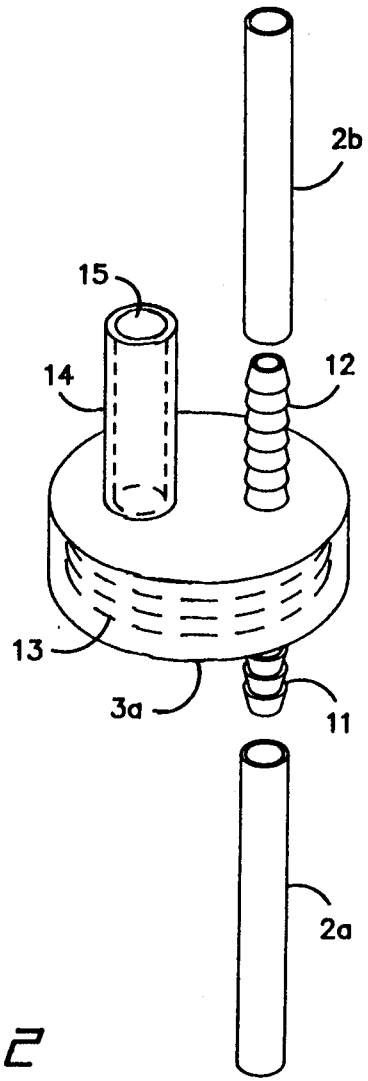
FIG. 2 is a detailed view of the container cap and tube segments of the device shown in FIG. 1.

Referring now to FIG. 2, the container cap 3*a* comprises fluid tight connecting means 11 and 12 which extend from opposite sides of the container cap to interconnect the tube segments 2*a*, 2*b*. The fluid tight connecting means 11 and 12 are similar and each comprise a ridged annular projection extending from the cap 3*a* which is adapted to be frictionally (i.e. fluid tightly) received within an end opening of the respective tube segment 2*a*, 2*b*. The frictional fit between the each of the projections and the respective tube segment end opening is effective to retain the respective tube segment in engagement with the cap 3*a*. Moreover, a passageway which extends through the cap 3*a* is formed between the annular projections. Thus, the tube segments 2*a*, 2*b* and the cap 3*a* together provide an unobstructed internal passage which extends into and out of the reservoir 3 and which is able to accommodate a flow of detergent.

Moreover, as seen in FIG. 2, the container cap 3*a* is provided with screw threads 13 for engaging corresponding screw threads on the reservoir 3, whereby the container cap 3*a* is removably retained on the reservoir 3. Additionally, the container cap 3*a* is provided with a projecting spout 14 comprising a vent hole 15 for allowing air into and/or detergent out of the reservoir 3.

Figure 3:
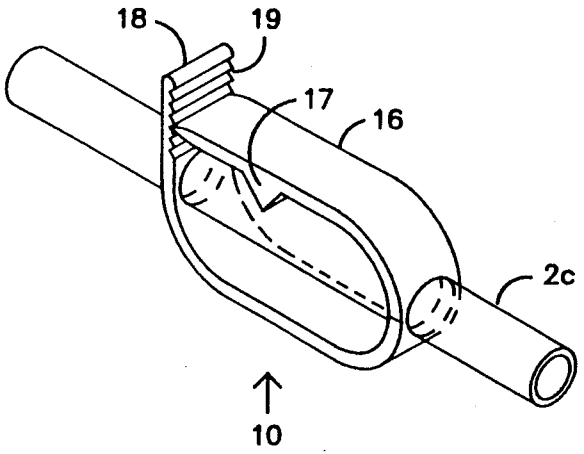
FIG. 3 is a detailed view of the pinch clamp shown in the device of FIG. 1.

Referring now to FIG. 3, the pinch clamp 10 is shown mounted around the tube segment 2*c* so as to constitute a valve. The pinch clamp 10 comprises a flange portion 16 having a projection 17 adapted to abut against and deform a sidewall of the tubing so as to close off the internal passage therein. A locking portion 18 of the pinch clamp 10 comprises a series of locking ridges 19 which normally engage and constrain a tip of the flange portion against lateral movement.

The operation of the pinch clamp is as follows:

The pinch clamp normally allows a flow of fluid within the tube segment 2*c*. If it is desired to cut off fluid flow, the flange portion may be pressed towards the tube segment 2*c* (e.g. while the locking portion 18 is being pulled away from the flange portion 16), causing the tip of the flange portion to ride over the ridges 19 and the projection 17 to deform a sidewall of the tube segment 2*c*, thereby closing an internal passage thereof. When a pressure on the flange portion is released, the ridges 19 on the locking member 18 prevent the tip of the flange portion from moving away from the tube segment 2*c*. Consequently, the flow of fluid within the tube segment remains cut off by the pinch clamp even after pressure on the flange portion is released. If it is desired to reestablish fluid flow in the tube segment 2*c*, it is necessary only to pull the locking member out of engagement with the flange portion (e.g. by deforming the locking member 18 in the direction of the tube segment 2*c* away from the flange portion 16).

Figure 4:
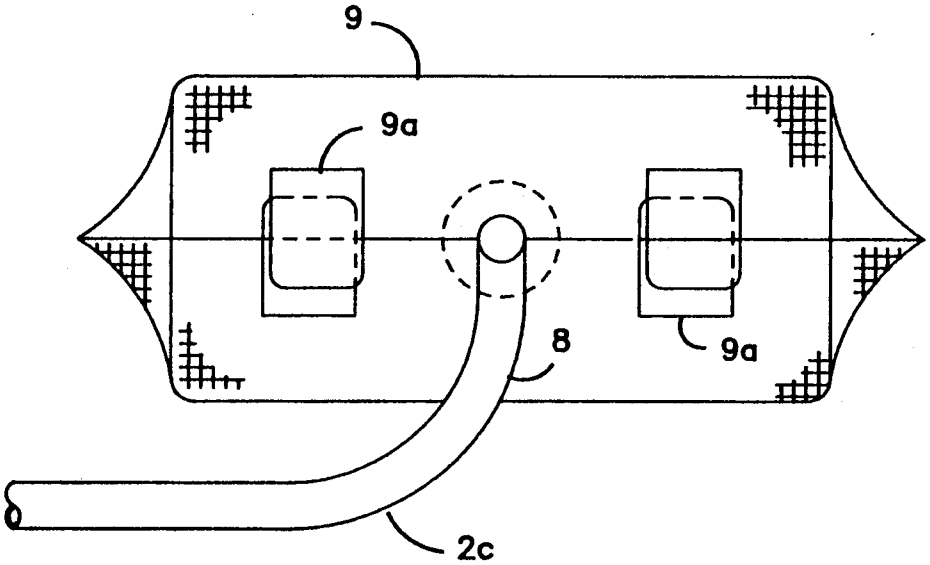
FIG. 4 is an end view of the sponge shown in FIG. 1 with the protective jacket secured thereto.

Referring lastly to FIG. 4, the nylon sleeve 9 is shown covering the sponge 4 and having its separable fasteners 9*a* closed so as to retain the sleeve in position around the sponge.

The operation of the device for washing automobiles is as follows:

Initially, the reservoir is filled with a detergent formula comprising a mixture of a concentrated biodegradable, non-phosphorous washing agent and a (e.g. dishwashing) spot clarifier diluted in water. Thereafter, the first length of tubing is inserted into the reservoir and the reservoir is capped with the container cap. Next, while holding the vent hole closed, the reservoir is squeezed so as to cause a flow of detergent formula from the reservoir, through the tube segments 2*a*, 2*b*, 2*c*, and to the sponge 4. At this time, the vent hole may be released and the reservoir may be placed on top of a car to be washed and the nylon sleeve covered sponge may be manipulated to wash the car. After the body panels and/or windows of the car are washed, the pinch clamp may be closed to stop the flow of detergent formula in the tubing. Next, the reservoir may be inverted, and any detergent formula that remains in the reservoir may be directed onto the tires and/or wheels of the vehicle by use of the projecting spout on the container cap. In this manner, the washing of the entire car is performed effectively, efficiently, and with a minimum of water.

After several car washes, it may become necessary to replace the nylon sleeve. To accomplish this, it is merely necessary to undo the hook and loop type fasteners, slip the old sleeve off the sponge, slip a new sleeve on the sponge, and close the separable fasteners provided on the new sleeve to secure it to the sponge.

According to the invention, since the sponge is surrounded by the nylon sleeve and since detergent is constantly flowing out from the center of the sponge, the sponge is, for the most part, protected and self-cleaning. Consequently, it is not envisioned that the sponge will often need to be replaced. However, should such a replacement become desirable or necessary, the tube segments 2*b*, 2*c* may be separated from each other and a new sponge (e.g. with a new tube segment 2*c*) or other cleaning implement may be provided.

While the present invention has been described with certain particularity, many modifications are envisioned. For example, the second length of tubing could comprise three tube segments, wherein the third tube segment would be a short tube segment secured within the passage of the sponge and connected to the second tube segment (e g. 2*c*) adjacent to an edge of the sponge. Furthermore, the tube segment 2*c* may be positively coupled to the sponge 4 e.g. by means of an oversized end stop which is secured to the end of the tube segment and which axially retains the sponge 4 on the tube segment. Moreover, it will be possible to provide one or more plastic suction cups on strategic portions of the length of tubing 2 (as shown in FIG. 1) and/or the container 3. The suction cups will serve to provide stability to the container if and when the tubing is pulled by the user. Therefore, the present invention includes the disclosed embodiment and any modifications thereof which will fall within the scope of the appended claims.

I claim:

1. A device for washing automobiles, comprising:

a container cap;

a first length of tubing extending from one side of the container cap;

a second length of tubing extending from a second side of the container cap;

passage means extending through the container cap for connecting an internal passage of the first length of tubing with an internal passage of the second length of tubing;

means for at least substantially closing an end of the second length of tubing remote from the container cap;

a plurality of small openings formed in a portion of the second length of tubing in a vicinity near the end of the second length of tubing;

an element of porous, absorbent material secured to the second length of tubing and covering the plurality of small openings; and a protective jacket disposed around and substantially covering the element of porous, absorbent material;

wherein the container cap is adapted to be secured to an opening of a detergent-holding container after the first length of tubing has been inserted into the detergent-holding container, wherein the internal passage of the second length of tubing is adapted to carry a flow of detergent from the detergent-holding container to the small openings, and wherein the small openings are adapted to carry the detergent to the element of porous, absorbent material;

and wherein the device further comprises:

valve means for selectively closing the internal passage of the second length of tubing, whereby the valve means is adapted to selectively prevent the flow of detergent in the internal passage of the second length of tubing.

2. The device as recited in claim 1, wherein the protective jacket is removably secured around the element of porous, absorbent material by means of at least one separable fastener.

3. The device as recited in claim 2, wherein the at least one separable fastener comprises a hook-and-loop type fastener.

4. The device as recited in claim 3, wherein the protective jacket is made in the form of a nylon sleeve.

5. The device as recited in claim 1, wherein the element of porous, absorbent material comprises a sponge, wherein a passage is provided in a central portion of the sponge, and wherein the portion of the second length of tubing comprising the small openings is received and secured within the passage of the sponge.

6. The device as recited in claim 5, wherein the portion of the second length of tubing comprising the small openings is secured within the passage of the sponge by means of chemical bonding.

7. The device as recited in claim 1 wherein the first length of tubing comprises a first tube segment, wherein the second length of tubing comprises a second tube segment, and wherein the container cap comprises fluid tight connecting means extending from opposite sides thereof for interconnecting the first tube segment and the second tube segment in a fluid tight manner.

8. The device as recited in claim 1, wherein the valve means is mounted around an outer portion of the second length of tubing.

9. The device as recited in claim 8, wherein the valve means comprises a pinch clamp having a flange portion which is adapted to be pinched so as to press against and deform a sidewall portion of the second length of tubing, thereby preventing the flow of detergent in the internal passage of the second length of tubing.

10. The device as recited in claim 9, wherein the flange portion comprises a tip, wherein the pinch clamp further comprises a locking portion comprising a series of ridges, and wherein the tip of the flange portion is adapted to be held in the pinched position by engagement with one of the series of ridges.

11. The device as recited in claim 1, wherein the second length of tubing comprises at least two tube segments, and wherein at least one fluid tight connecting means is employed for interconnecting the at least two tube segments so as to form the second length of tubing.

12. The device as recited in claim 1, wherein the first length of tubing comprises a first tube segment, the second length of tubing comprises a second tube segment, and wherein fluid tight connecting means are provided for interconnecting the first and second tube segments.

13. The device as recited in claim 12, wherein the second length of tubing further comprises a third tube segment, and wherein the second and third tube segments are joined together by an additional fluid tight connecting means at a position between the container cap and the element of porous, absorbent material.

14. The device as recited in claim 1, wherein the container cap is further provided with a vent hole for allowing air to pass through the container cap.

15. The device as recited in claim 14, wherein the cap comprises a projecting spout, and wherein the vent hole is provided within the projecting spout.

16. The device as recited in claim 1, wherein the container cap is threaded.

17. The device as recited in claim 1, wherein an end cap is provided to close off the end of the second length of tubing.

18. The device as recited in claim 17, wherein the end of the second length of tubing is received within the passage of the element of porous, absorbent material and is covered by the protective jacket.

19. The device as recited in claim 1, wherein the first length of tubing comprises a first tube segment and the second length of tubing comprises a second tube segment, and wherein the container cap comprises both:

a first ridged annular projection which is received within an end opening of the first tube segment; and a second rigid annular projection which is received within an end opening of the second tube segment.

20. The device as recited in claim 1, wherein the protective jacket comprises a nylon sleeve which is removably secured around the element of porous, absorbent material by means of at least one hook-and-loop type fastener, and wherein a suction cup is secured to a portion of the second length of tubing.

* * * * *